US005882442A

United States Patent [19]

Caron et al.

[11] Patent Number: 5,882,442

[45] Date of Patent: Mar. 16, 1999

[54] IRON MODIFIED PHOSPHOR-BRONZE

[75] Inventors: Ronald N. Caron, Branford; John F. Breedis, Trumbull; W. Gary Watson, Cheshire; William Brenneman; Richard P. Vierod, both of Cheshire, all of Conn.; Dennis R. Brauer, Brighton, Ill.; Derek E. Tyler, Cheshire, Conn.

[73] Assignee: Olin Corporation, New Haven, Conn.

[21] Appl. No.: 591,065

[22] Filed: Feb. 9, 1996

Related U.S. Application Data

[60] Provisional application No. 60/005,743 Oct. 20, 1995.

[51] Int. Cl.[6] ..... C22C 9/02

[52] U.S. Cl. ..... 148/433; 420/472; 420/473

[58] Field of Search ..... 148/433; 420/472, 420/473

[56] References Cited

U.S. PATENT DOCUMENTS

| | | | |
|---|---|---|---|
| 130,702 | 8/1872 | Dick | 420/469 |
| 632,233 | 9/1899 | Bull | 420/472 |
| 2,128,954 | 9/1938 | Montgomery et al. | 420/472 |
| 2,128,955 | 9/1938 | Montgomery et al. | 420/472 |
| 2,210,670 | 8/1940 | Kelly | 420/473 |
| 3,039,867 | 6/1962 | McLain | 420/496 |
| 3,639,119 | 2/1972 | McLain | 420/473 |
| 3,698,965 | 10/1972 | Ence | 148/411 |
| 3,930,894 | 1/1976 | Shapiro et al. | 148/554 |
| 4,249,941 | 2/1981 | Futatsuka et al. | 420/473 |
| 4,486,250 | 12/1984 | Nakajima | 148/433 |
| 4,586,967 | 5/1986 | Shapiro et al. | 428/469 |
| 4,627,960 | 12/1986 | Nakajima et al. | 420/471 |
| 4,666,667 | 5/1987 | Kamio et al. | 420/471 |
| 4,822,562 | 4/1989 | Miyafuji et al. | 420/472 |
| 4,927,467 | 5/1990 | Kusakawa et al. | 164/463 |
| 4,935,076 | 6/1990 | Yamaguchi et al. | 148/433 |
| 5,370,840 | 12/1994 | Caron et al. | 420/492 |

FOREIGN PATENT DOCUMENTS

| | | |
|---|---|---|
| 57-68061 | 4/1982 | Japan . |
| 63-67539 | 7/1983 | Japan . |
| 58-218701 | 12/1983 | Japan . |
| 61-186441 | 8/1986 | Japan . |
| 1-165733 | 6/1989 | Japan . |
| 2-170935 | 7/1990 | Japan . |
| 2-170936 | 7/1990 | Japan . |
| 3-285053 | 12/1991 | Japan . |
| 4-354 | 1/1992 | Japan . |
| 4-231430 | 8/1992 | Japan . |
| 4-231446 | 8/1992 | Japan . |
| 4-231447 | 8/1992 | Japan . |
| 5-311291 | 11/1993 | Japan . |

OTHER PUBLICATIONS

"Recent Developments in Properties and Protection of Copper for Electrical Uses" by S.G. Temple, appearing in Metallurgical Reviews, vol. 11 (1966) (The Institute of Metals 1966) at pp. 47–60.

*Primary Examiner*—Sikyin Ip

*Attorney, Agent, or Firm*—Gregory S. Rosenblatt; Wiggin & Dana

[57] ABSTRACT

There is provided a phosphor bronze alloy having a grain structure that is refined by the addition of a controlled amount of iron. Direct chill cast alloys containing from 1.5% to 2.5%, by weight tin, from 1.65% to 2.65% iron, from 0.03% to 0.35% phosphorous and the remainder copper and inevitable impurities have an as-cast average crystalline grain size of less than 100 microns and are readily hot worked. When the iron content is too low, the average crystalline grain size increases and the alloy cracks during hot working. When the iron content is too high, iron stringers form, detrimentally impacting both the appearance and properties of a wrought strip.

4 Claims, 5 Drawing Sheets

IRON MODIFIED PHOSPHOR-BRONZE

CROSS REFERENCE TO RELATED APPLICATION

This application claims the benefit of U.S. Provisional Application No. 60/005,743, filed Oct. 20, 1995.

BACKGROUND OF THE INVENTION

1. Field of the Invention

This invention relates to copper alloys having high strength, good formability and relatively high electrical conductivity. More particularly, the crystalline grain structure of a phosphor-bronze is refined by an iron addition.

2. Description of Related Art

Throughout this patent application, all percentages are given in weight percent unless otherwise specified.

Commercial phosphor-bronze contains from 1%–10% tin, from 0.03%–0.35% phosphorous and the balance copper. These alloys have excellent cold processability, high tensile strength, high yield strength and good formability. The alloys are particularly suited for applications requiring repetitive motion or stress such as fasteners, electrical connectors, springs, electrical switches and wire brushes.

The use of phosphor-bronze is limited because the alloys are prone to cracking during hot working, such as rolling at elevated temperature. In addition, the electrical conductivity of the alloys is rather low. Copper alloy C51000, (nominal composition 94.9% copper, 5% tin and 0.1% phosphorus) has an electrical conductivity of approximately 15% IACS at 20° C. IACS refers to conductivity as defined by the International Annealed Copper Standard and rates "pure" copper as having an IACS of 100% at 20° C.

It is known that the addition of iron to phosphor-bronze improves the hot working characteristics of the alloy. U.S. Pat. No. 2,128,955 to Montgomery discloses the addition of 0.25%–5% iron to a phosphor-bronze containing 2%–20% iron. U.S. Pat. No. 4,249,941 to Futatsuka et al. discloses a copper alloy for electrical applications containing 0.5%–1.5% iron, 0.5%–1.5% tin, 0.01%–0.35% phosphorous and the balance copper. Futatsuka et al disclose that increasing the iron content above 1.5% results in degradation of the elongation capability and of the electrical conductivity.

Japanese patent application number 57-68061 by Furukawa Metal Industries Company, Ltd. discloses a copper alloy containing 0.5%–3.0%, each, of zinc, tin and iron. It is disclosed that iron increases the strength and heat resistance of the alloy.

While the benefit of an iron addition to phosphor-bronze is known, iron causes problems for the alloy. The electrical conductivity of the alloy is degraded and processing of the alloy is impacted by the formation of stringers. Stringers form when properitectic iron particles precipitate from liquid prior to solidification and elongate during mechanical deformation. Stringers are detrimental because they affect the surface appearance of the alloy and can change the formability characteristics.

There exists, therefore, a need for an iron modified phosphor-bronze alloy that does not suffer from the stated disadvantages of reduced electrical conductivity and stringer formation.

SUMMARY OF THE INVENTION

Accordingly, it is an object of the invention to provide a phosphor-bronze having improved hot processability. It is a feature of the invention that improved hot processability is achieved through the addition of controlled amounts of iron, producing an as-cast alloy with a fine grain structure. It is another feature of the invention that by processing the alloy according to a specified sequence of steps, the fine microstructure is retained in the wrought alloy.

Among the advantages of the alloy of the invention are that hot processability is improved without a degradation in electrical conductivity. The microstructure of both the as-cast alloy, grain size less than 100 microns, and the wrought alloy, grain size of about 5–20 microns, is fine grain. Still another advantage is that the electrical conductivity is increased relative to copper alloy C51000 without any degradation in yield strength or resistance to stress relaxation.

In accordance with the invention, there is provided a cast copper alloy. This alloy consists essentially of from 1.5% to 2.5% by weight tin, from 1.65% to 4.0% by weight iron, from 0.03% to 0.35% by weight phosphorus and the remainder is copper, as well as inevitable impurities. The alloy has an average as-cast grain size of less than 100 microns and an average grain size after processing of between about 5 and 20 microns.

The above stated objects, features and advantages will become more apparent from the specification and drawings that follow.

IN THE DRAWINGS

FIG. 1 graphically illustrates the relationship between yield strength and the content of iron and tin.

FIG. 2 graphically illustrates the relationship between the as-cast grain size and the content of both iron and tin.

FIG. 3 graphically illustrates the relationship between electrical conductivity and the content of iron and tin.

FIG. 4 graphically illustrates the relationship between the length of iron stringers and the content of iron and tin.

FIG. 5 is a flow chart detailing processing of the phosphor-bronze alloys of the invention.

DETAILED DESCRIPTION

The copper alloys of the invention are an iron modified phosphor-bronze. The alloys consist essentially of from 1.5% to 2.5% tin, from 1.65% to 4.0% iron, from 0.03% to 0.35% by weight phosphorus and the remainder is copper along with inevitable impurities. As cast, the alloy has an average crystalline grain size of less than 100 microns.

When the alloy is cast by direct chill casting, in preferred embodiments, the tin content is from 1.5% to 1.9% and the iron content is from 1.65% to 2.65. Most preferably, the iron content is from 2.1% to 2.4%.

Figure 1:
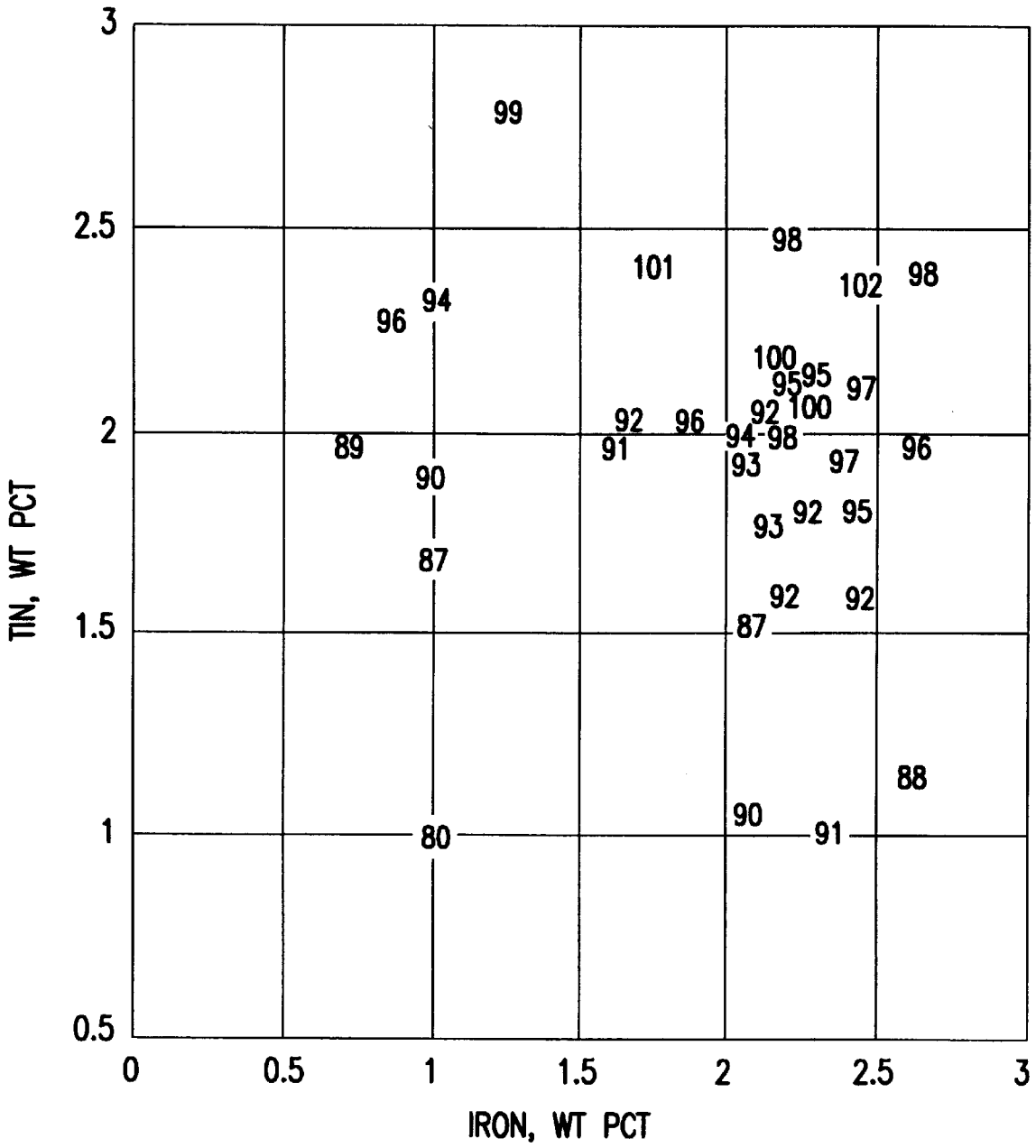

Tin increases the strength of the alloys as illustrated in FIG. 1. The values presented are yield strength in thousands of pounds per square inch (ksi). The alloy is in the spring temper and has been relief annealed.

Moving vertically upward (increasing tin content) along the graph leads to an increase in yield strength. Tin also increases resistance of the alloy to stress relaxation.

Tin makes the alloys more difficult to process, particularly during hot processing. When the tin content exceeds 2.5%, the cost of processing the alloy may be prohibitive for certain commercial applications. When the tin content is less than 1.5%, the alloy lacks adequate strength and resistance to stress relaxation for spring applications.

Figure 2:
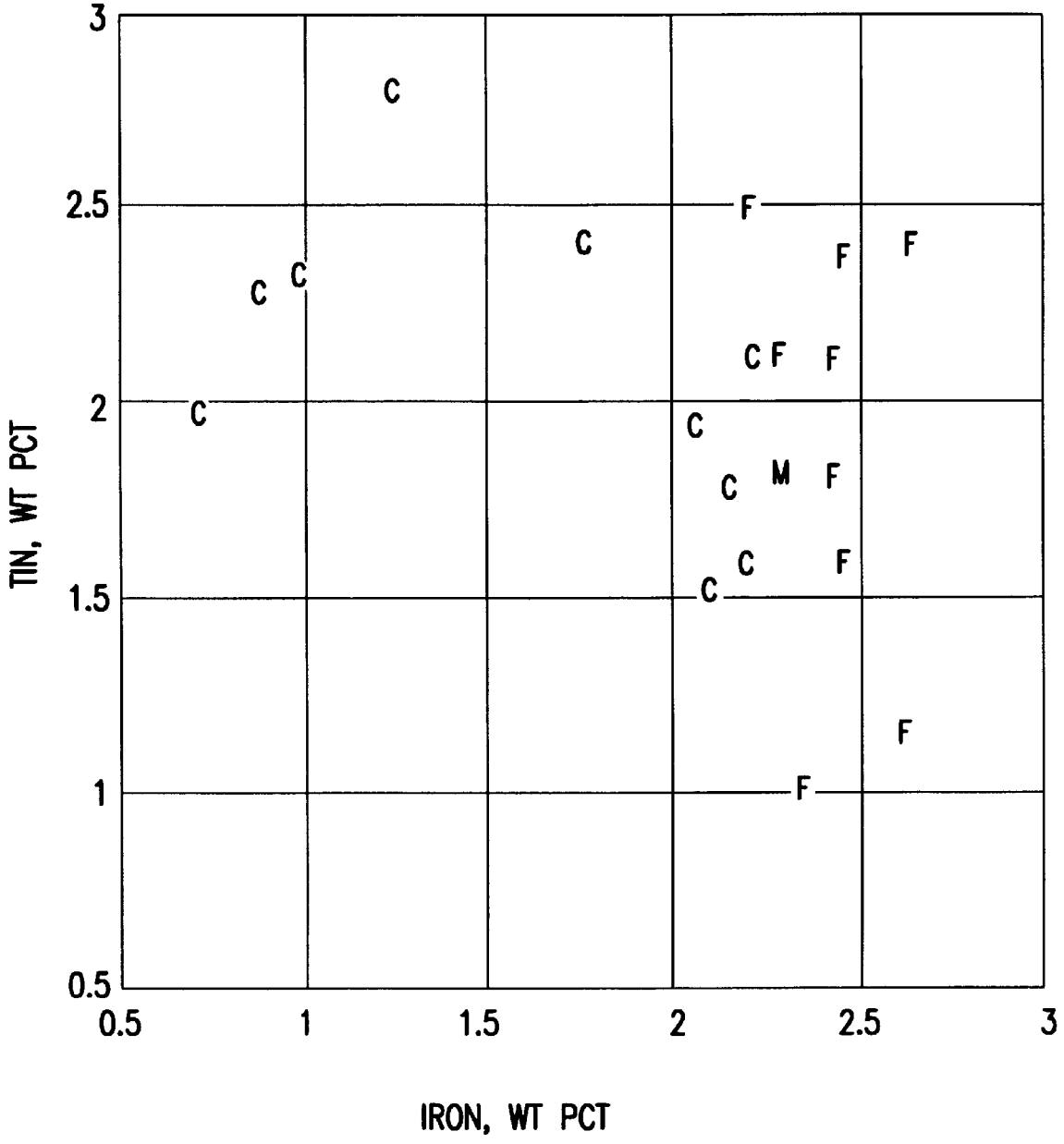

Referring to FIG. 2, iron refines the microstructure of the as-cast alloy containing from 0.030% to 0.054% phosphorous and the specified amounts of tin and iron. The fine microstructure has an average grain size of less than 100 microns. Preferably, the average grain size is from 30 to 90 microns and most preferably, from 40 to 70 microns. This fine microstructure facilitates mechanical deformation at elevated temperatures, such as rolling at 850° C. When the iron content is less than about 2.1%, the grain refining effect is reduced and coarse crystalline grains, with an average grain size on the order of 600–2060 microns develop. When the iron content exceeds 2.5%, stringers develop during hot working.

The grain refining effect of iron is illustrated in FIG. 2 that illustrates the grain size of as-cast alloys having various iron and tin contents. In FIG. 2:

"F" represents a fine crystalline grain having an average grain size 40 to about 70 microns.

"M" represents a medium grain size having an average grain size 70 to about 90 microns.

"C" represents a coarse grain size having an average crystalline grain 600 to about 2000 microns.

Figure 3:
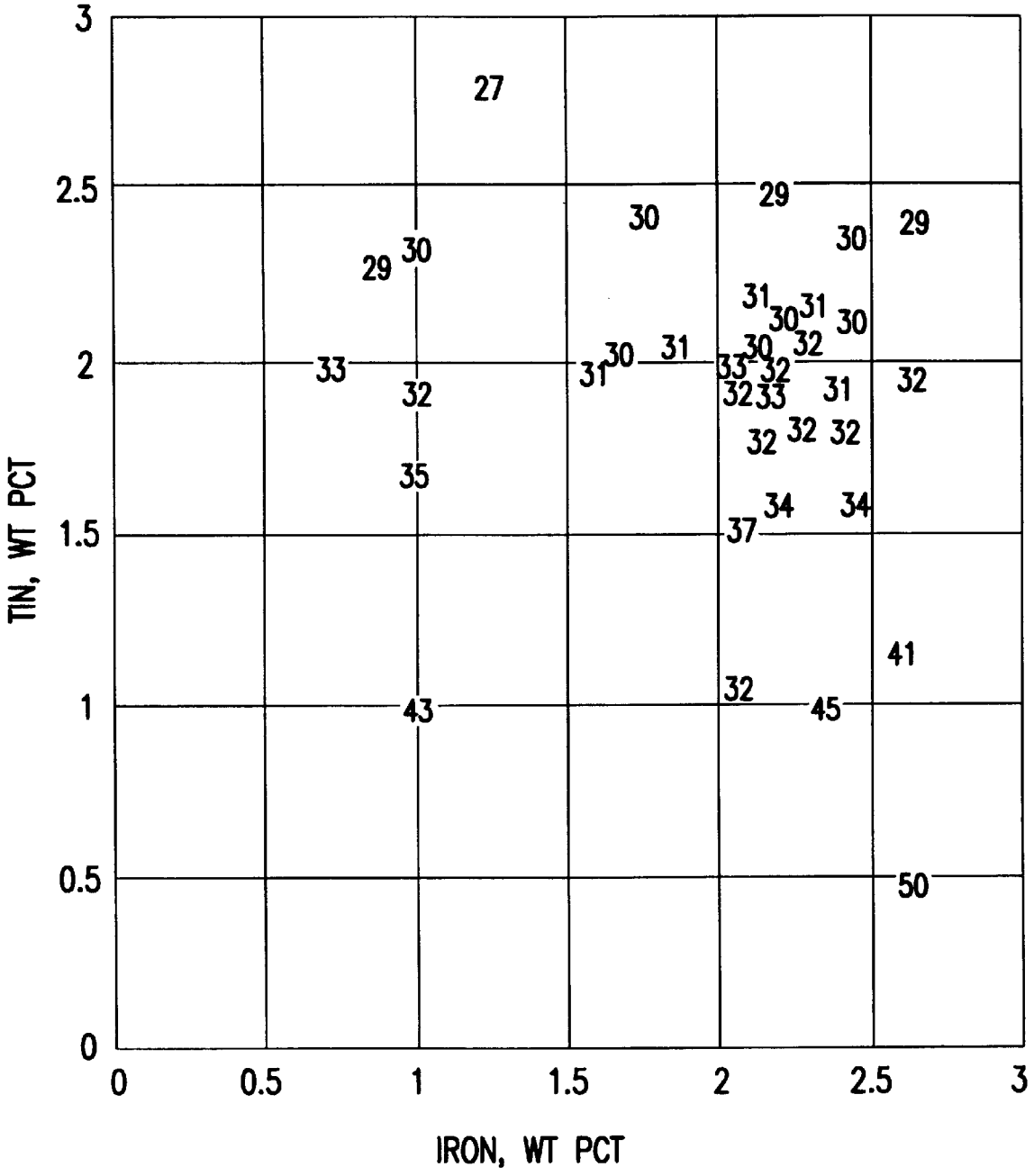

FIG. 3 graphically illustrates the electrical conductivity in % IACS of the alloy in the spring temper following a relief anneal. The electrical conductivity is presented as a function of the tin content and the iron content. Moving vertically upward along the 1% iron or 2.5% iron line shows that increasing the tin content causes a decrease in electrical conductivity.

Moving horizontally from left to right at tin contents between 1.5% and 2.5% shows that in this critical range, increasing the iron content from 1.65% through 2.65% has almost no effect on conductivity.

Figure 4:
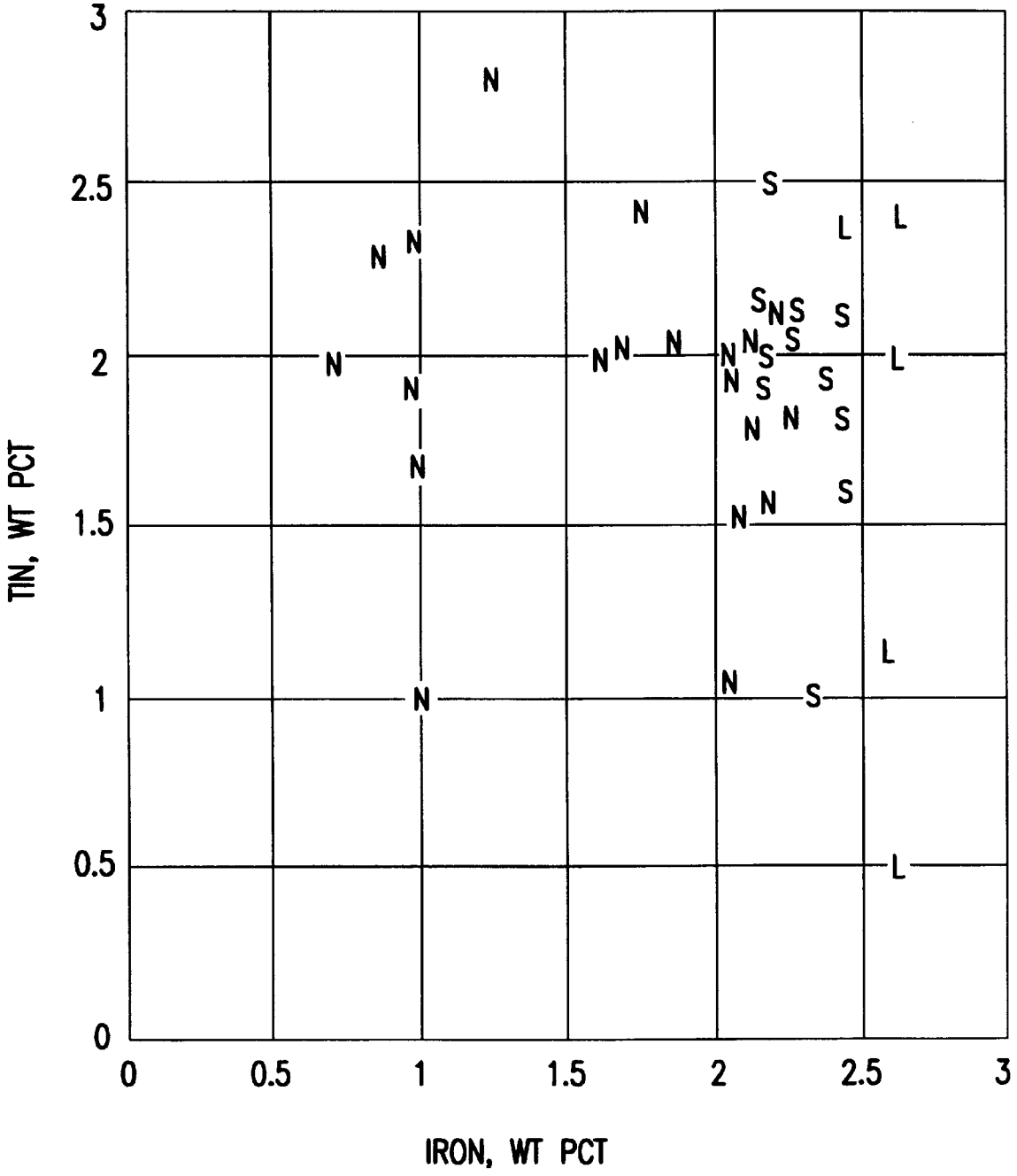

FIG. 4 graphically illustrates the size of iron stringers resulting from deformation of the properitectic iron phase that appear in the microstructure due to hot and cold processing. The length of the stringers after processing to a spring temper and relief annealing is presented as a function of both the tin content and the iron content. In FIG. 4:

"N" indicates that no iron stringers are expected to form.

"S" indicates small, having a length less than about 200 microns, stringers are expected to form.

"L", indicates stringers, having a length in excess of about 200 microns, are expected to form.

From FIG. 4, the vertical line at 2.5% iron shows why the iron content is maintained at less than about 2.5%. To the right of this line, at any tin content, large stringers form; to the left of the line, almost no large stringers form.

The large stringers impact both the appearance of the alloy surface as well as the properties, electrical and chemical, of the surface. The large stringers can change the solderability and electroplatability of the alloy.

Phosphorous is added to the alloy for conventional reasons, to prevent the formation of copper oxide or tin oxide precipitates and to promote the formation of iron phosphides. The phosphorous causes problems with the processing of the alloy, particularly with hot rolling. It is believed that the iron addition counters the detrimental impact of phosphorous. At least a minimal amount of iron must be present to counteract the impact of the phosphorous.

Additions of other elements may be made to the alloy to adjust the properties for specific applications. Such additions include those soluble in the copper matrix such as nickel, aluminum, zinc and manganese. Alternatively, the additional elements include those that form a second phase precipitate, in addition to the iron phosphide, such as magnesium, beryllium, cobalt, silicon, zirconium, titanium and chromium.

Each addition is preferably present in an amount of less than about 0.4% and most preferably, in an amount of less than about 0.2%. Most preferably, the sum of all alloying additions is less than about 0.5%.

Figure 5:
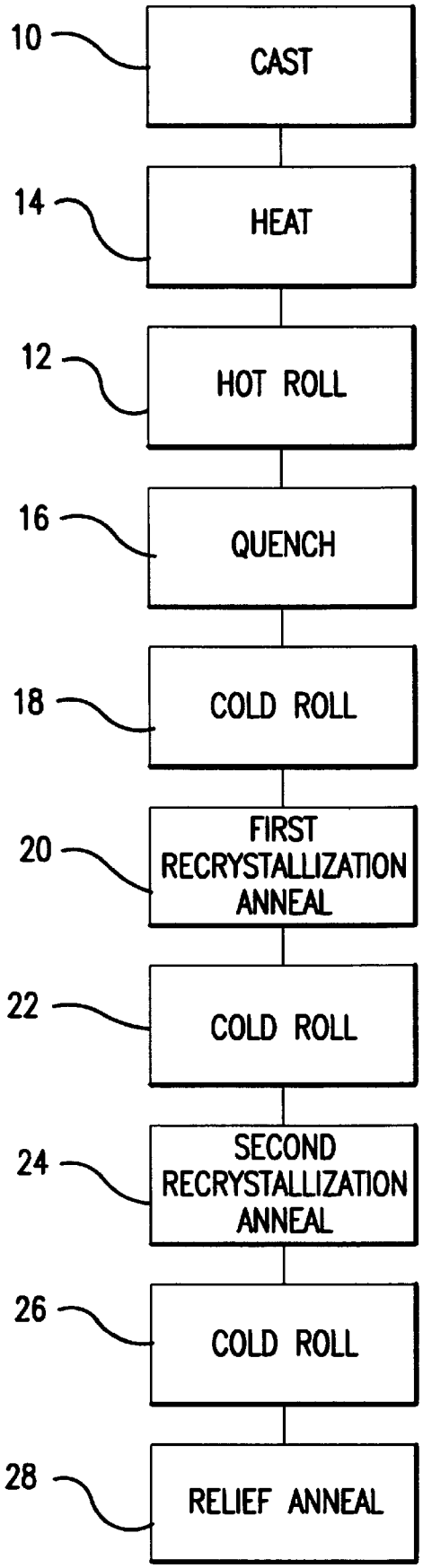

The alloys of the invention are preferably processed according to the flow chart of FIG. 5. An ingot is cast 10 by a conventional process such direct chill casting. The alloy is hot rolled 12, at a temperature of from about 650° C. to about 950° C. and preferably, at a temperature of between about 825° C. and 875° C. Optionally, the alloy is heated 14 to maintain the desired hot roll 12 temperature.

The hot rolling reduction is, typically, by thickness, up to 98% and preferably, from about 80% to about 95%. The hot rolling may be in a single pass or in multiple passes, provided that the temperature of the ingot is maintained at above 650° C.

After hot rolling 12, the alloy is, optionally, water quenched 16. The bars are then mechanically milled to remove surface oxides and then cold rolled 18 to a reduction of at least 60%, by thickness, from the gauge at completion of the hot roll step 12, in either one or multiple passes. Preferably, the cold roll reduction 18 is from about 60%–90%.

The strip is then annealed 20 at a temperature between 400° C. and 600° C. for a time of from about 0.5 hour to about 8 hours to recrystallize the alloy. Preferably, this first recrystallization anneal is at a temperature between 500° C. and 600° C. for a time between 3 and 5 hours. These times are for bell annealing in an inert atmosphere such as nitrogen or in a reducing atmosphere such as a mixture of hydrogen and nitrogen.

The strip may also be strip annealed, such as for example, at a temperature of 600° C. to 950° C. for from 0.5 minute to 10 minutes.

The first recrystallization anneal 20 causes additional precipitates of iron and iron phosphide to develop. These precipitates control the grain size during this and subsequent anneals, add strength to the alloy via dispersion hardening and increase electrical conductivity by drawing iron out of solution from the copper matrix.

The bars are then cold rolled 22 a second time to a thickness reduction of from 30%–70% and preferably of from 35%–45%.

The strip is then given a second recrystallization anneal 24, utilizing the same times and temperatures as the first recrystallization anneal. After both the first and second recrystallization anneals, the average grain size is between 3 and 20 microns. Preferably, the average grain size of the processed alloy is from 5 to 10 microns.

The alloys are then cold rolled 26 to final gauge, typically on the order of 0.010 inch–0.015 inch. This final cold roll imparts a spring temper comparable to that of copper alloy C51000.

The alloys are then relief annealed 28 at a temperature of between 200° C. and 300° C. for from 1 to 4 hours to optimize resistance to stress relaxation. One exemplary relief anneal is a bell anneal in an inert atmosphere.

Alloys processed according to FIG. 5 have mechanical properties, such as yield strength and ultimate tensile strength, comparable to that of copper alloy C51000, but require only half the tin content. The bend formability was also comparable to copper alloy C51000 and the electrical conductivity was much higher than that of the copper alloy C51000.

Following the relief anneal 28, the copper alloy strip is formed into a desired product such as a spring or an electrical connector.

The advantages of the alloys of the invention will become more apparent from the examples that follow.

EXAMPLES

Table 1 identifies a series of alloys processed according to FIG. 5. Alloys A through L represent the alloys of the invention and alloys M through U are control alloys. Alloy N is commercial copper alloy C51000.

The tensile properties of yield strength, ultimate tensile strength and elongation were measured utilizing American Society for Testing and Materials (ASTM) standards and a copper strip with a 2 inch gauge length.

The electrical conductivity was measured by the Kelvin bridge method.

Bend formability was measured by bending a 0.5 inch wide strip 180° about a mandrel having a known radius. The minimum mandrel about which the strip could be bent without cracking or "orange peeling" is the bend formability value.

The "good way" bend is perpendicular to the longitudinal axis (rolling direction) during thickness reduction of the strip while the "bad way" is parallel to that longitudinal axis. Bend formability is recorded as MBR/t, the minimum bend radius at which cracking or orange peeling is not apparent divided by the thickness of the strip.

The resistance to stress relaxation is recorded as percent stress remaining after a strip sample is preloaded to 80% of the yield strength in a cantilever mode per ASTM specifications. The strip is heated to 125° C. for the specified number of hours and retested periodically. The properties were measured at up to 3000 hours at 125° C. The higher the stress remaining, the better the utility of the specified composition for spring applications.

TABLE 1

| | COMPOSITION % | | | TENSILE PROPERTIES | | | ELECTRICAL CONDUCTIVITY | BEND FORMABILITY MBR/t | | % STRESS REMAINING @ 125° C. (ksi) | |
|---|---|---|---|---|---|---|---|---|---|---|---|
| ALLOY | Sn | Fe | P | YS (ksi) | UTS (ksi) | EL (%) | % IACS | GW | BW | 1000 Hrs. | 3000 Hrs. |
| A | 1.94 | 2.06 | .054 | 93 | 97 | 7 | 32.1 | 1.6 | 4.3 | — | — |
| B | 1.52 | 2.09 | .050 | 87 | 91 | 7 | 36.9 | 1.3 | 3.7 | 88 | 82 |
| C | 1.78 | 2.15 | .032 | 93 | 97 | 8 | 32.4 | 1.3 | 4.0 | — | — |
| D | 1.59 | 2.20 | .033 | 92 | 96 | 8 | 34.1 | 1.6 | 4.0 | — | — |
| E | 2.49 | 2.20 | .030 | 98 | 102 | 8 | 28.8 | 1.6 | 4.4 | 82 | 78 |
| F | 2.12 | 2.22 | .036 | 95 | 99 | 8 | 29.9 | 1.3 | 4.8 | — | — |
| G | 1.81 | 2.28 | .033 | 92 | 96 | 8 | 31.9 | 1.6 | 4.0 | — | — |
| H | 2.13 | 2.28 | .053 | 95 | 98 | 6 | 30.7 | 1.6 | 4.3 | — | — |
| I | 1.81 | 2.43 | .035 | 95 | 99 | 8 | 32.1 | 1.3 | 4.8 | — | — |
| J | 2.12 | 2.44 | .035 | 97 | 101 | 8 | 29.6 | 1.9 | 4.0 | — | — |
| K | 1.60 | 2.45 | .034 | 92 | 96 | 7 | 34.1 | 1.3 | 4.0 | — | — |
| L | 2.37 | 2.46 | .040 | 102 | 105 | 8 | 30.0 | 1.6 | 5.6 | 83 | 79 |
| M | 1.15 | 2.61 | .041 | 88 | 92 | 7 | 41.4 | 1.1 | 3.2 | 86 | 81 |
| N | 4.27 | 0 | .033 | 96 | 101 | 14 | 22.6 | 1.1 | 3.6 | 85 | 79 |
| O | 1.98 | .71 | .036 | 93 | 93 | 9 | 32.5 | 1.3 | 4.4 | — | — |
| P | 2.28 | .87 | .032 | 96 | 100 | 10 | 29.0 | 1.3 | 4.2 | 82 | 78 |
| Q | 2.32 | .99 | .037 | 94 | 97 | 9 | 29.8 | 1.1 | 4.0 | — | — |
| R | 2.79 | 1.25 | .037 | 99 | 103 | 9 | 26.6 | 1.6 | 4.8 | — | — |
| S | 2.41 | 1.76 | .040 | 101 | 105 | 8 | 30.0 | 1.6 | 5.6 | 84 | 80 |
| T | 1.01 | 2.34 | .040 | 91 | 94 | 6 | 44.7 | 1.6 | 3.6 | 87 | 82 |
| U | 2.40 | 2.65 | .052 | 98 | 102 | 8 | 29.1 | 1.6 | 5.7 | 85 | 81 |

The alloys of Table 1 illustrate the increase in tensile properties achieved by the alloys of the invention without a loss of electrical conductivity. Table 2 compares two alloys of the invention, alloys "A" and "L" with three control alloys, alloys "O", "U" and "Q" to illustrate this effect. Despite similar tin contents and electrical conductivity, the alloys of the invention have significantly higher tensile strengths.

TABLE 2

| ALLOY | TIN CONTENT (%) | YIELD STRENGTH (ksi) | ULTIMATE TENSILE STRENGTH (ksi) | ELECTRICAL CONDUCTIVITY % IACS |
|---|---|---|---|---|
| A | 1.94 | 93 | 97 | 32.1 |
| O | 1.98 | 89 | 93 | 32.5 |
| L | 2.37 | 102 | 105 | 30.0 |
| U | 2.40 | 98 | 102 | 29.1 |
| L | 2.37 | 102 | 105 | 30.0 |
| Q | 2.32 | 94 | 97 | 29.8 |

Table 3 identifies the criticality of the iron content to the "bad way" bends and is a function of the iron content. It is believed that the iron stringers may contribute to the bad bends at iron contents in excess of about 2.55%.

TABLE 3

| ALLOY | IRON CONTENT (%) | BEND FORMABILITY (Bad way) (MBR/t) |
|---|---|---|
| I | 2.43 | 4.8 |
| J | 2.44 | 4.0 |
| K | 2.45 | 4.0 |
| L | 2.56 | 5.6 |
| U | 2.65 | 5.7 |

While described particularly in terms of direct chill casting, the alloys of the invention may be cast by other processes as well. Some of the alternative processes have higher cooling rates such as spray casting and strip casting. The higher cooling rates reduce the size of the properitectic iron particles and are believed to shift the critical maximum iron content to a higher value such as 4%.

It is apparent that there has been provided in accordance with the invention an iron modified phosphor bronze that fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A copper alloy having improved bad way bend formability, consisting essentially of:

from 1.59% to 1.9% by weight tin;

from 2.15% to 2.55% by weight iron;

from 0.03% to 0.35% by weight phosphorous; and the remainder copper and inevitable impurities, said alloy having an as-cast average crystalline grain size of less than 100 microns, an electrical conductivity in excess of 30% IACS, a bad way bend formability (MBR/t) of less than 4.0 and an ultimate tensile strength of in excess of 95 ksi.

2. The copper alloy of claim 1 wherein said as cast crystalline grain size is from 30 to 90 microns.

3. The copper alloy of claim 1 further containing an addition selected from the group consisting of nickel, aluminum, zinc, manganese, magnesium, beryllium, cobalt, silicon, zirconium, titanium, chromium and mixtures thereof, wherein each component of said addition is present in an amount of less than 0.4% by weight.

4. The copper alloy of claim 3 wherein the sum of all said components of said addition is less than 0.5% by weight.

* * * * *